US009956675B2

(12) United States Patent
Heep et al.

(10) Patent No.: US 9,956,675 B2
(45) Date of Patent: May 1, 2018

(54) HAMMER DRIVE MECHANISM

(71) Applicant: Black & Decker Inc., Newark, DE (US)

(72) Inventors: Tobias Heep, Steinbach (DE); Stefan Gensmann, Frucht (DE); Achim Buchholz, Limburg (DE); Rainer Kleem, Neidernhausen (DE)

(73) Assignee: Black & Decker Inc., New Britain, CT (US)

( * ) Notice: Subject to any disclaimer, the term of this patent is extended or adjusted under 35 U.S.C. 154(b) by 617 days.

(21) Appl. No.: 14/560,611

(22) Filed: Dec. 4, 2014

(65) Prior Publication Data

US 2015/0158167 A1 Jun. 11, 2015

(30) Foreign Application Priority Data

Dec. 11, 2013 (GB) ..... 1321894.6

(51) Int. Cl.

*B25D 17/26* (2006.01)
*B25D 11/12* (2006.01)
*B25D 16/00* (2006.01)

(52) U.S. Cl.

CPC ..... *B25D 11/12* (2013.01); *B25D 11/125* (2013.01); *B25D 16/006* (2013.01); *B25D 17/26* (2013.01); *B25D 2217/0096* (2013.01); *Y10T 74/2142* (2015.01)

(58) Field of Classification Search

CPC ..... B25D 16/00; B25D 11/12; B25D 17/26
USPC ..... 173/117, 48, 201, 140, 90
See application file for complete search history.

(56) References Cited

U.S. PATENT DOCUMENTS 3,162,268 A * 12/1964 Short ..... B25D 17/26 112/256
4,365,962 A * 12/1982 Regelsberger ..... B25D 16/003 173/104
6,666,284 B2 * 12/2003 Stirm ..... B25D 16/00 173/104
7,413,026 B2 * 8/2008 Berghauser ..... B25D 17/08 173/109
7,814,986 B2 * 10/2010 Berghauser ..... B25D 17/08 173/109
2004/0149469 A1 * 8/2004 Colangelo, III ..... B25B 21/026 173/93.5

(Continued)

FOREIGN PATENT DOCUMENTS

DE 3910599 A1 * 10/1990 ..... B25D 11/12

*Primary Examiner* — Andrew M Tecco
(74) *Attorney, Agent, or Firm* — Amir R. Rohani

(57) ABSTRACT

A hammer drive mechanism is provided for converting rotary drive from a motor to reciprocatory movement of an impact member of a hammer drill. The mechanism comprises a rotatable plate adapted to be rotated by the motor, an input drive member associated with the rotatable plate in an eccentric position with respect to the axis of rotation of the rotatable plate, an output drive member associated with the impact member, and a crank shaft having a respective driver adjacent each of its ends. Each driver engages with, and is complementary to a respective one of the drive members. At least one end portion of the crank shaft comprises a lubricating aperture which opens into the adjacent driver to provide a lubrication path to the engaging surfaces of the drivers and the drive members.

10 Claims, 4 Drawing Sheets

(56) References Cited

U.S. PATENT DOCUMENTS

| | | | | |
|---|---|---|---|---|
| 2008/0006425 | A1* | 1/2008 | Berghauser | B25D 17/24<br>173/201 |
| 2009/0277657 | A1* | 11/2009 | Berger | B25D 17/24<br>173/114 |
| 2010/0012337 | A1* | 1/2010 | Meixner | B25D 11/125<br>173/114 |
| 2013/0319712 | A1* | 12/2013 | Massler | B25D 11/06<br>173/201 |

* cited by examiner

HAMMER DRIVE MECHANISM

CROSS-REFERENCE TO RELATED APPLICATIONS

This application claims priority, under 35 U.S.C. § 119, to UK Patent Application No. 1321894.6 filed Dec. 11, 2013, titled "Hammer Drive Mechanism."

FIELD OF THE INVENTION

The present invention relates to a crank shaft for a hammer drive mechanism of a hammer drill, to a hammer drive mechanism incorporating such a hammer drive mechanism, and to a hammer drill incorporating such a hammer drive mechanism.

BRIEF SUMMARY OF THE INVENTION

A hammer drill can have a single mode of operation, namely hammering; or can have three modes of operation, namely a hammer only mode, a drill only mode, and a hammer and drill mode. Throughout this specification, the term hammer drill should be taken to include both types mentioned above. A three mode hammer drill typically comprises a spindle mounted for rotation within a housing which can be selectively driven by a rotary drive arrangement within the housing. The rotary drive arrangement is driven by a motor also located within the housing. The spindle rotatingly drives a tool holder of the hammer drill which in turn rotatingly drives a cutting tool, such as a drill bit, releaseably secured within it. Within the spindle is generally mounted a piston which can be reciprocatingly driven by a hammer drive mechanism which translates the rotary drive of the motor to a reciprocating drive of the piston. A ram, also slidably mounted within the spindle, forward of the piston, is reciprocatingly driven by the piston due to successive over and under pressures in an air cushion formed within the spindle between the piston and the ram. The ram repeatedly impacts a beat piece slidably located within the spindle forward of the ram, which in turn transfers the forward impacts from the ram to the cutting tool releaseably secured, for limited reciprocation, within the tool holder at the front of the hammer drill. A mode change mechanism can selectively engage and disengage the rotary drive to the spindle and/or the reciprocating drive to the piston. Thus, in the hammer only mode, there is only the reciprocating drive to the piston; in the drill only mode, there is only the rotary drive to the spindle, and in the hammer and drill mode, there is both the rotary drive to the spindle the reciprocating drive to the piston. The specification of WO 03/041915 discloses such a hammer drill.

A single mode hammer drill is similar to the three mode version, but does not include a rotary drive arrangement for driving the tool holder or with mode change mechanism.

The present invention is concerned with both types of hammer drill mentioned above.

Aspects of the present invention relate to a hammer drive mechanism, to a hammer drill incorporating such a mechanism, and to a crank shaft for such a hammer mechanism.

According to a further aspect the present invention provides a hammer drive mechanism for converting rotary drive from a motor to reciprocatory movement of an impact member of a hammer drill, the mechanism comprising a rotatable plate adapted to be rotated by the motor, an input drive member associated with the rotatable plate in an eccentric position with respect to the axis of rotation of the rotatable plate, an output drive member associated with the impact member, and a crank shaft having a respective driver adjacent each of its ends, each driver engaging with, and being complementary to, a respective one of the drive members, wherein at least one end portion of the crank shaft comprises a lubricating aperture which opens into the adjacent driver to provide a lubrication path to the engaging surfaces of the driver and drive member.

The end portions of the crank shaft can each comprise one said lubricating aperture. The lubricating aperture can extend transversely, for example extending through a sidewall of the crank shaft. The lubricating aperture can, for example, be a cut-out, a bore or a slot. It will be appreciated that more than one lubricating aperture could be formed in each end portion of the crank shaft.

In a preferred embodiment, a respective pin constitutes each of the drive members. A respective locating aperture, such as a through hole, in the crank shaft can constitute each of the drivers. The locating aperture can be a bore which extends partially or completely through the end portion of the crank shaft. The lubricating aperture can be arranged substantially orthogonal to a longitudinal axis of the locating aperture.

The mechanism can further comprise a first gear wheel drivable by a drive pinion of the motor, and a second gear wheel whose teeth mesh with the teeth of the first gear wheel, the second gear wheel being non-rotatably mounted on a drive spindle to which the drive plate is non-rotatably mounted.

Preferably, the output drive member is fixed to one end of a piston reciprocatable within a cylinder, a ram being reciprocatable driven by reciprocation of the piston via an air cushion formed within the cylinder between the piston and the ram, the impact member being fixed to the ram.

The crank shaft can be made of a metal, such as steel or aluminium. Alternatively, the crank shaft can be made of a plastics material, such as polypropylene. The plastics material could be fibre reinforced. The crank shaft could, for example, be injection moulded from a plastics material.

The invention also provides a crank shaft for use in the hammer drive mechanism defined above. The crank shaft can be provided with a respective driver adjacent each of its ends, each driver being engageable with, and complementary to, a respective drive member forming part of the hammer drive mechanism. At least one end portion of the crank shaft can comprise a lubricating aperture which opens into the adjacent driver to provide a lubrication path to the engaging surfaces of the driver and drive member.

The end portions of the crank shaft can each comprise one said lubricating aperture. The lubricating aperture can extend transversely, for example extending through a sidewall of the crank shaft. The lubricating aperture can, for example, be a cut-out, a bore or a slot. It will be appreciated that more than one lubricating aperture could be formed in each end portion of the crank shaft.

A respective pin can constitute each of the drive members. A respective locating aperture in the crank shaft can constitute each of the drivers. The locating aperture can, for example, be a through hole. In a preferred embodiment, a respective pin constitutes each of the drive members. A respective locating aperture, such as a through hole, in the crank shaft can constitute each of the drivers. The locating aperture can be a bore which extends partially or completely through the end portion of the crank shaft. The lubricating aperture can be arranged substantially orthogonal to a longitudinal axis of the locating aperture.

The invention still further provides a hammer drill comprising a casing, a motor mounted in the casing, a tool holder associated with the casing, and a hammer drive mechanism as defined above.

In a preferred embodiment, the hammer drill comprises include a rotary drive arrangement for rotatably driving the tool holder, and with a mode change mechanism for controlling the drill for a hammer only mode, a rotary drilling only mode, or a combined hammer and rotary drilling mode.

a. Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one embodiment are applicable to all embodiments, unless such features are incompatible.

BRIEF DESCRIPTION OF THE DRAWINGS

An embodiment of a hammer drill according to the present invention will now be described by way of example with reference to the accompanying drawings, in which.

DETAILED DESCRIPTION OF THE INVENTION

Figure 1:
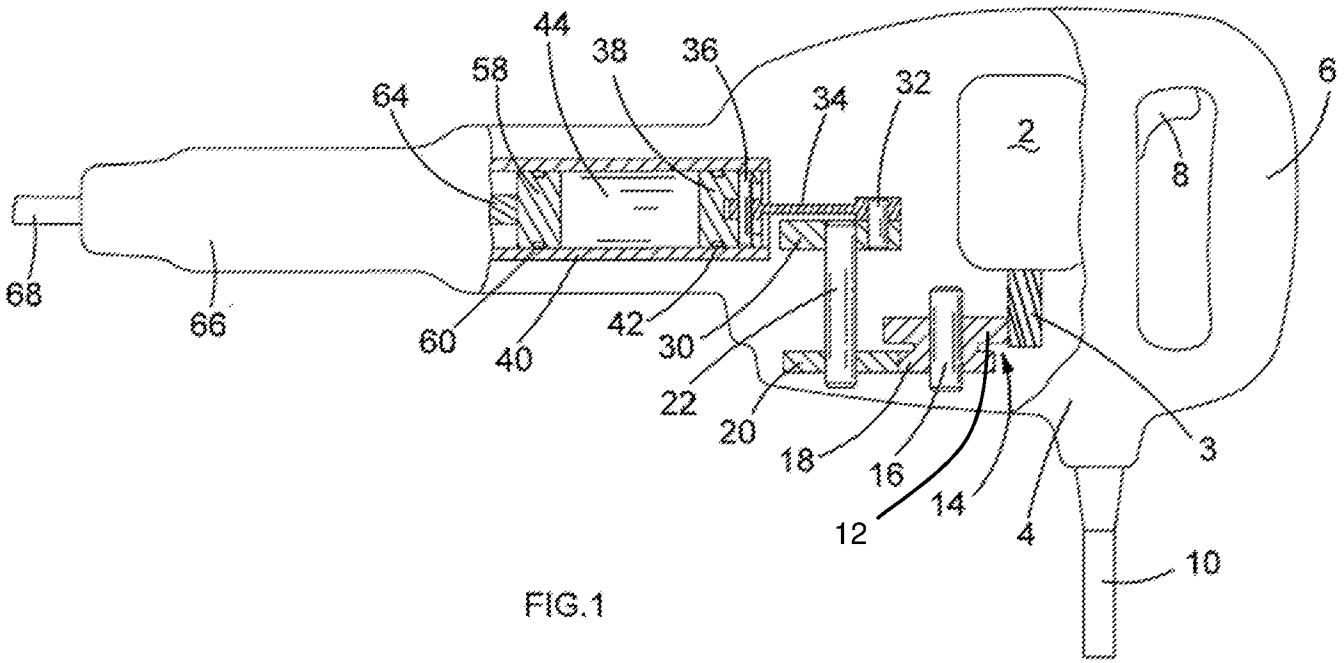
FIG. 1 is a partially cutaway longitudinal cross-section through a prior art hammer drill.

A partially cutaway longitudinal cross-section through a prior art hammer drill 1 is shown in FIG. 1. The hammer drill 1 comprises an electric motor 2, an intermediate gear arrangement and a crank drive arrangement which are housed within a metal gear housing (not shown) surrounded by a plastics housing 4. A rear handle housing incorporating a rear handle 6 and a trigger switch arrangement 8 is fitted to the rear of the housing 4. A cable (not shown) extends through a cable guide 10 and connects the motor 2 to an external electricity supply. Thus, when the cable is connected to the electricity supply and the trigger switch arrangement 8 is depressed, the motor 2 is actuated to rotate the armature of the motor.

The motor 2 is provided with a drive pinion 3 is formed with teeth which engage the teeth of a first gear wheel 12 of an intermediate gear arrangement 14 to rotate the intermediate gear arrangement. The intermediate gear arrangement 14 is rotatably mounted on a spindle 16, which spindle is mounted in an insert to the gear housing. The intermediate gear arrangement 14 has a second gear wheel 18 which has teeth which engage the teeth of a crank spindle drive gear 20 to rotate the drive gear. The drive gear 20 is non-rotatably mounted on a drive shaft 22 which spindle is rotatably mounted within the gear housing. A crank plate 30 is non-rotatably mounted at the end of the drive spindle 22 remote from the drive gear 20, which crank-plate is formed with an eccentric bore for housing an eccentric crank pin 32. The crank pin 32 extends from the crank plate 30 into a through hole at the rearward end of a crank shaft 34 so that the crank shaft can pivot about the crank pin 32. The opposite forward end of the crank shaft 34 is formed with a through hole through which extends a trunnion pin 36 so that the crank shaft 34 can pivot about the trunnion pin. The trunnion pin 36 is fitted to the rear of a piston 38 by fitting the ends of the trunnion pin 36 into receiving bores formed in a pair of opposing arms, which arms extend to the rear of the piston 38. The piston 38 is reciprocally mounted in a cylindrical hollow spindle 40 so that it can reciprocate within the hollow spindle. An O-ring seal 42 is fitted in an annular recess formed in the periphery of the piston 38 so as to form an air tight seal between the piston and the internal surface of the hollow spindle 40.

Thus, when the motor 2 is actuated, the drive pinion 3 rotates the intermediate gear arrangement 14 via the first gear wheel 12, and the second gear wheel 18 of the intermediate gear arrangement rotates the drive shaft 22 via the drive gear 20. The drive spindle 22 rotates the crank plate 30 and the crank arm arrangement comprising the crank pin 32, the crank shaft 34 and the trunnion pin 36 convert the rotational drive from the crank plate to a reciprocating drive to the piston 38. In this way the piston 38 is reciprocatingly driven back and forth along the hollow spindle 40, when the motor 2 is actuated by depression of the trigger switch 8.

A ram 58 is located within the hollow spindle 40 forwardly of the piston 38 so that it can also reciprocate within the hollow spindle. An O-ring seal 60 is located in a recess formed around the periphery of the ram 58 so as to form an air-tight seal between the ram and the spindle 40. In the operating position of the ram 58, with the ram located rearward of venting bores (not shown) in the spindle, a closed air cushion 44 is formed between the forward face of the piston 38 and the rearward face of the ram 58. Thus, reciprocation of the piston 38 reciprocatingly drives the ram 58 via the closed air cushion 44. When the hammer drill enters idle mode (that is to say when the hammer bit is removed from a workpiece), the ram 58 moves forwardly, past the venting bores. This vents the air cushion and so the ram 58 is no longer reciprocatingly driven by the piston 38 in idle mode, as is well known in the art.

A beatpiece (impact member) 64 is guided so that it can reciprocate within a tool holder 66 which tool holder is mounted forwardly of the spindle 40. A bit or tool 68 can be releasably mounted within the tool holder 66 so that the bit or tool 68 can reciprocate to a limited extent within the tool holder. When the ram 58 is in its operating mode, and is reciprocatingly driven by the piston 38, the ram repeatedly impacts the rearward end of the beatpiece 64, and the beatpiece transmits these impacts to the rearward end of the bit or tool 68 as is known, in the art. These impacts are then transmitted by the bit or tool 68 to the material being worked.

A disadvantage of this hammer drill is that it is susceptible to wear, particularly where the crank shaft 34 engages with the crank pin 32 and the trunnion 36. Thus, although the interior of the drill is lubricated, insufficient lubricant reaches the engaging surfaces of the through holes in the ends of the crank shaft 34 and the pin 32 and the trunnion 36 to provide adequate lubrication. This problem can cause extensive wear which can substantially reduce the working life of the hammer drill 1.

FIGS. 2 to 5 show part of the hammer drive mechanism constructed in accordance with the invention, the hammer drive mechanism being a modification of that of the hammer drill of FIG. 1. As many of the parts of this hammer drive mechanism are the same as the equivalent parts of the hammer drive mechanism of FIG. 1 like reference numerals will be used for like parts and only the modifications will be described in detail.

Figure 2:
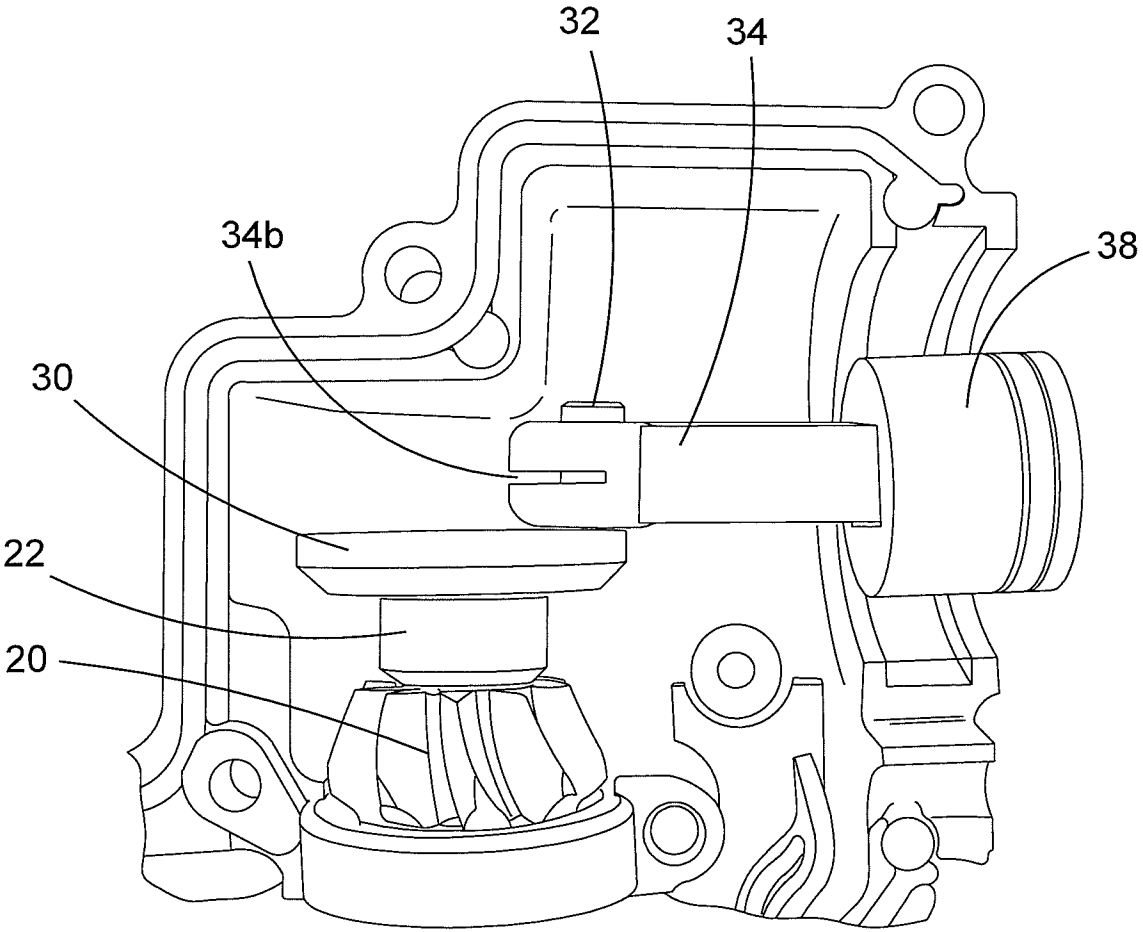
FIG. 2 is a perspective view, on an enlarged scale, of part of a hammer drive mechanism constructed in accordance with the invention.
Figure 3:
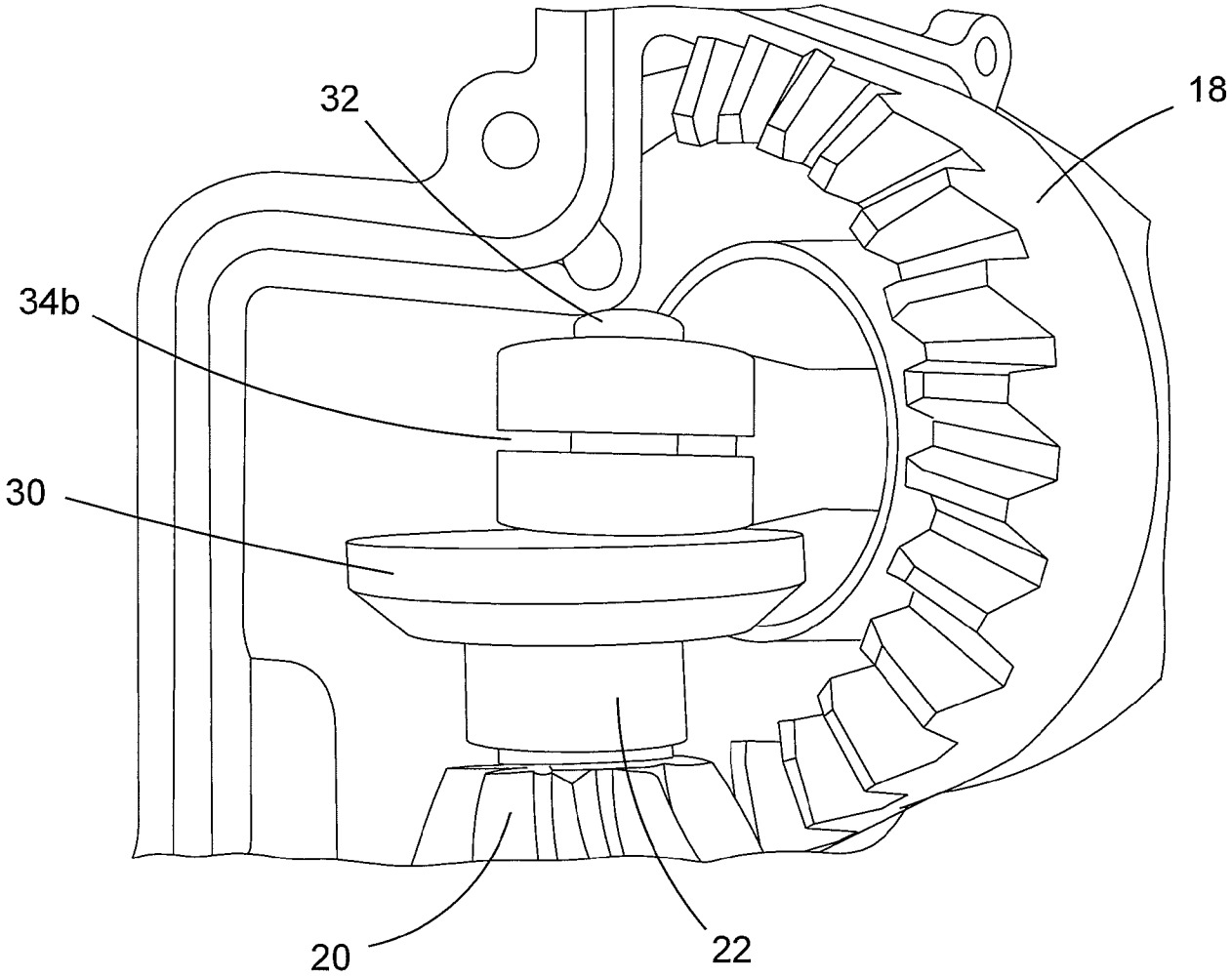
FIG. 3 is a perspective view, on an enlarged scale, of part of the hammer drive mechanism of FIG. 2 showing the mechanism from a different viewpoint.

As shown in FIGS. 2 and 3, the gear wheel 18 has teeth which engage with teeth of the drive gear 20. The drive gear 20 is non-rotatably mounted on the crank drive spindle 22, and the crank plate 30 is non-rotatably mounted on the end of the drive spindle 22 remote from the drive gear 20. The crank plate 30 is provided with the eccentric crank pin 32 which extends from the crank plate into a through hole 34*a* (see FIGS. 4 and 5) of the crank shaft 34. Another through hole 34*a* at the other end of the crank shaft 34 surrounds the trunnion pin 36 (not shown in FIGS. 2 to 5). The crank shaft 34 is moulded from a plastics material in the present embodiment, but could be made of metal.

Figure 4:
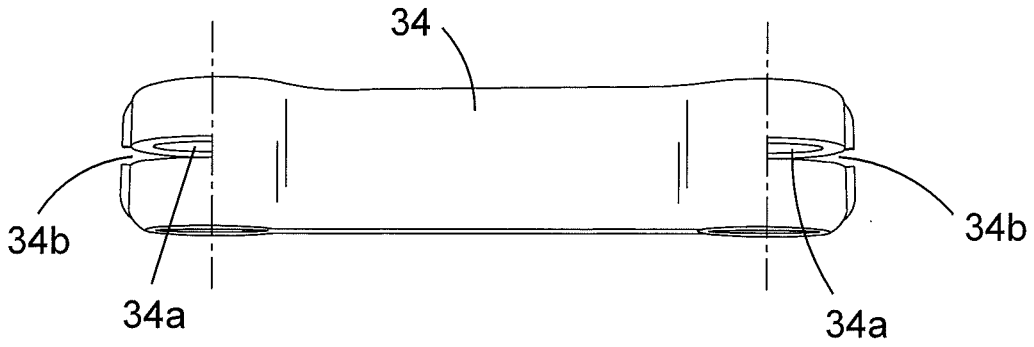
FIG. 4 is perspective view, on an enlarged scale, of a crank shaft forming part of the mechanism of FIGS. 2 and 3.
Figure 5:
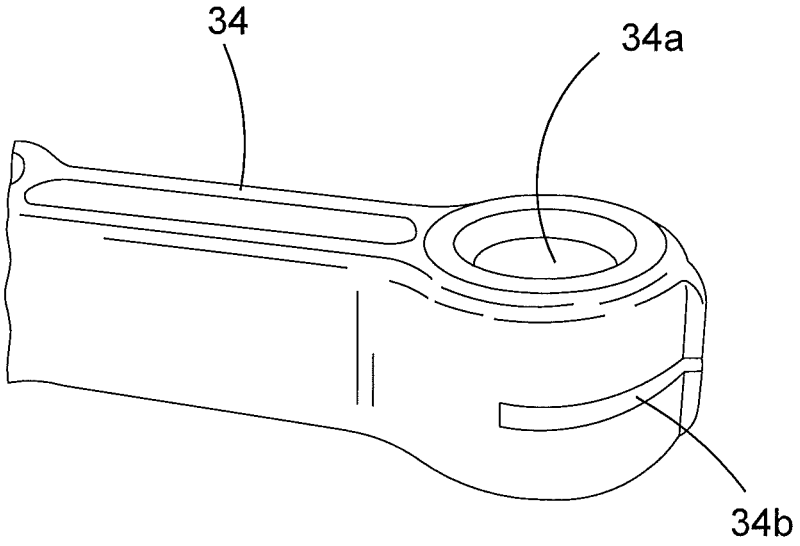
FIG. 5 is a perspective view, on an enlarged scale, of one end of the crank shaft of FIG. 4.

As shown best in FIG. 4, the crank shaft 34 is formed with lubricating apertures in the form of slots 34*b* at each end thereof, each of the slots 34*b* opening up into the adjacent through hole 34*a*. These slots 34*b* provide lubricant paths to the engaging surfaces of the through holes 34*a*, the crank pin 32 and the trunnion 36, and so ensure an adequate supply of lubricant to those engaging surfaces. This increased supply of lubricant can help to reduce the risk of wear to those engaging surfaces and may increase the working life of the hammer drill 1.

Although the hammer drive mechanism of the invention has been described above as part of a hammer drill, it will be apparent that it could be incorporated in a drill having three modes of operation (hammer only, drill only, and combined hammer and drill). In this case the drill described above would be modified to include a rotary drive arrangement for providing rotary drive to the tool holder 66 and bit or tool 68. As is well known in the art, such a drill would be provided with a switching mechanism for changing the mode of operation.

The invention claimed is:

1. A hammer drive mechanism for converting rotary drive from a motor to reciprocatory movement of an impact member of a hammer drill, the mechanism comprising:
- a rotatable plate adapted to be rotated by the motor;
- an input drive member associated with the rotatable plate in an eccentric position with respect to an axis of rotation of the rotatable plate;
- an output drive member associated with the impact member; and
- a crank shaft having a respective driver adjacent each of its ends;
- wherein each driver engages with and is complementary to a respective one of the input drive member and the output drive member; and
- wherein at least one end portion of the crank shaft comprises a lubricating aperture circumferentially disposed around a portion of a periphery of its respective adjacent driver which opens into the respective adjacent driver to provide a lubrication path to the engaging surfaces of the respective adjacent driver and the respective one of the input drive member and the output drive member.

2. The mechanism of claim 1, wherein a respective pin constitutes each of the drive members, and a respective locating aperture in the crank shaft constitutes each of the drivers.

3. The mechanism of claim 2, wherein each lubricating aperture is disposed orthogonal to a longitudinal axis of the locating aperture.

4. The mechanism of claim 1, wherein each end portion of the crank shaft comprises one said lubricating aperture.

5. The mechanism of claim 1, wherein each lubricating aperture is a slot formed in the end portion of the crank shaft.

6. The mechanism of claim 1, further comprising a first gear wheel drivable by a drive pinion of the motor, and a second gear wheel whose teeth mesh with the teeth of the first gear wheel, the second gear wheel being non-rotatably mounted on a drive spindle to which the drive plate is non-rotatably mounted.

7. The mechanism of claim 1, wherein the output drive member is fixed to one end of a piston reciprocatable within a cylinder, and wherein the impact member is fixed to a ram, the ram being reciprocatable and driven by reciprocation of the piston via an air cushion formed within the cylinder between the piston and the ram.

8. The mechanism of claim 1, wherein the crank shaft is made of a metal or a plastics material.

9. A hammer drill comprising:
- a casing;
- a motor mounted in the casing;
- an impact member;
- a tool holder associated with the casing; and
- a hammer drive mechanism comprising:
  - a rotatable plate adapted to be rotated by the motor;
  - an input drive member associated with the rotatable plate in an eccentric position with respect to an axis of rotation of the rotatable plate;
  - an output drive member associated with the impact member; and
  - a crank shaft having a respective driver adjacent each of its ends;
  - wherein each driver engages with and is complementary to a respective one of the input drive member and the output drive member; and
  - wherein at least one end portion of the crank shaft comprises a lubricating aperture circumferentially disposed around a portion of a periphery of its respective adjacent driver which opens into the respective adjacent driver to the provide a lubrication path to the engaging surface of the respective adjacent driver and the respective one of the input drive member and the output drive member.

10. The hammer drill of claim 9, further comprising a rotary drive arrangement for rotatably driving the tool holder, and with a mode change mechanism for controlling the drill for a hammer only mode, a rotary drilling only mode, a combined hammer and rotary drilling mode.

* * * * *